US006039544A

United States Patent [19]

Strickland

[11] Patent Number: 6,039,544

[45] Date of Patent: Mar. 21, 2000

[54] OIL LIFT SYSTEM

[75] Inventor: Charles Strickland, Hampton, Ark.

[73] Assignees: Jerry Alexander; Kenneth L. Hofler, Sr., both of El Dorado, Ark.

[21] Appl. No.: 09/032,403

[22] Filed: Feb. 27, 1998

[51] Int. Cl.[7] ..... F04B 23/00; E21B 43/00

[52] U.S. Cl. ..... 417/53; 166/369

[58] Field of Search ..... 417/37, 53; 166/369, 166/69, 162, 107, 105

[56] References Cited

U.S. PATENT DOCUMENTS 4,830,113 5/1989 Geyer ..... 166/68
4,942,926 7/1990 Lessi ..... 166/385
4,962,847 10/1990 Pisors et al. ..... 198/643
5,054,557 10/1991 Wittrisch ..... 166/309

*Primary Examiner*—Thomas N. Moulis
*Assistant Examiner*—Mahmoud M. Gimie
*Attorney, Agent, or Firm*—Gunn & Associates, P.C.

[57] ABSTRACT

A wellhead assembly including a skid, drum, cable spooled on the drum and level wind mechanism is set forth to extend the cable into and out of a well borehole for production of a stripper well. The cable spools over a measuring wheel extends into the well and supports a bail on the end of it. The bail has a foot valve for filling, thereby enabling retrieval of a bail into a surface located stinger connected with a pump to drain the bail. A control system enables cyclic operation.

20 Claims, 2 Drawing Sheets

OIL LIFT SYSTEM

BACKGROUND OF THE DISCLOSURE

The present disclosure sets out an economical oil lift system which is installed with reduced capital expenditures, and which has the benefit of reduced lifting cost during operations. It is intended to be used on stripper wells. Stripper wells are defined as those producing typically up to about 10 barrels of oil per day. They may produce water with the oil in quantities ranging from perhaps 10 or 15 times the volume of oil to a negligible amount. As will be understood, stripper wells of that production volume simply are economically marginal and can be operated only if the capital costs and operational costs are reduced. The present disclosure sets out a method and apparatus for providing that kind of reduced capital and operational cost. The typical method of producing a stripper well is to install a wellhead pump jack, a string of sucker rods and a downhole pump. This requires pumping through a tubing string. To be sure, stripper wells are normally straight and relatively shallow requiring minimal installed equipment. Nevertheless, it is necessary to install the equipment in the well. This costs significantly to purchase and install the capital equipment. The wellhead equipment normally entails a walking beam and electric motor at the surface. That has a well known cost dependent on the size of the walking beam and motor. A well known and easily identified cost is also involved in the tubing and sucker rod string having a cost factor based on well depth. The downhole pump is installed at the lower end of the sucker rod string and has a well known cost.

Operational costs include the electricity required to power the pump, and periodic service of the wells. Servicing of a typical stripper well involves periodic removal of the sucker rod string, the tubing string and the downhole pump connected on that. Without regard to the nature of the service, the removal and reinstallation of these components involves a very significant and substantial economic outlay. This service routine is typically undertaken to clean out the well when there is an excessive accumulation of sand around the pump or paraffin along the tubing. Sometimes, the sucker rods must be pulled to inspect them and to make appropriate replacements or to install bumpers on them. Sometimes, sucker rods will drag, thereby damaging the surface of the rod string, and possibly wearing against the adjacent tubular goods. Service has a cost. Service for the present system is distinctly better. To begin with, the cased well is normally open from the wellhead down to the bottom of the well. The well is open so that the service personnel can work on the well without the delay of having to pull sucker rods and tubing. Service is done through the wellhead without the preliminary step of installing a workover rig to pull a few hundred feet of sucker rods. Indeed, a workover rig is often required to service shallow wells with pump jack and sucker rods. Workover rigs of necessity involve a larger truck which has to be driven to a remote location of the wellhead, erected over the wellhead and then operated to pull all the tubular goods in the well. That preliminary step, even where the well is only 600 feet deep, takes two or three skilled personnel and requires at least an hour or two of operation ignoring the difficulties of getting the truck to the site and then onto the highway after the service job has been completed. Suffice it to say, the difficulties of servicing can range from relatively easy to tedious and difficult. These are activities and service charges which are avoided by the present oil lift apparatus.

This disclosure sets out a wellhead system which is installed on a skid adjacent to the wellhead which utilizes no sucker rods. Rather, it employs a drum which spools a lifting cable. The drum, cable spooling apparatus and supportive frame or skid are mounted adjacent to the wellhead. This equipment need not be moved at the time of servicing. Rather, the equipment inserted into the well comprises solely a bailing bucket and a long cable. The wireline is spooled on the drum. The wireline is relatively small and has only sufficient diameter to support the weight which is carried on it (often, it is called a slick line). That diameter or cable gauge is discussed in some detail below. The produced oil (and any water which is found with it) is bailed out of the well by an elongate tubular bailing bucket. The bail is raised with a full load of liquid retrieved from the well. It is raised to the wellhead where the liquid is then removed by a pump. The pump has an elongate stinger which extends into the bail, thereby pumping the retrieved liquid out of the bail and into a gathering system. When the bail is in the up position at the top end of its stroke, it delivers the liquid, leaving the cased well substantially clear. For service work, the bail is simply pulled from the wellhead equipment, laid aside for the moment and easy entry into the well is then obtained. Easy entry reduces the setup time to begin service. If the well is sanded up, it is easy to run a wash line into the well to dislodge and retrieve the accumulated sand, etc. At the completion of the service work, the wash equipment is simply pulled from the well and the bail is reinserted into the well. Removal of equipment from the well and restoration of that equipment is done easily.

The present apparatus is summarized as equipment which is located at the surface. That equipment includes an elongate horizontal frame or skid which is either rested on the ground or elevated. The skid supports a cable winding mechanism adjacent to a cable storage drum. A level wind device is typically included. This provides a slick line which is extended from the storage reel or drum through the level winding device and then over a single measuring pulley. The pulley directs the cable downwardly into the well borehole. The equipment also includes certain load sensors which respond to the load on the slick line. The load on the line is measured dynamically so that the cable load alters the motor operation so that the cable is lowered from the surface, dropped into the liquid accumulated at the bottom of the well, filled and then the cable is retrieved with the filled bail on it. The bail, full of retrieved liquid, is pulled to the surface. When the bail arrives at the surface, a switch is triggered to stop further movement. In conjunction with that operation, a stinger is inserted into the bail to a depth to enable retraction by pump of the liquid in the bail. That is pumped off to a gathering system. When pumping is over, the bail is then lowered back into the well and the cycle is repeated.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
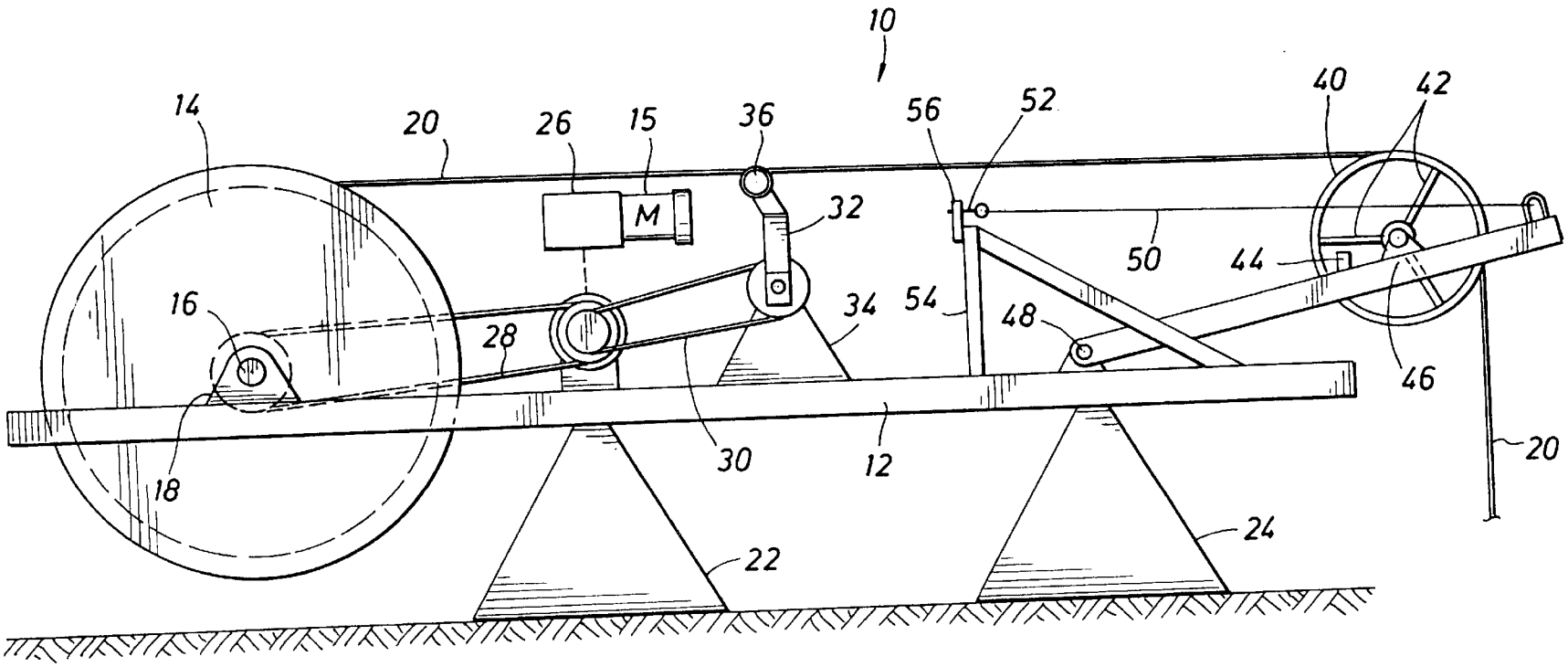
FIG. 1 is a side view showing the wellhead equipment of the present invention and includes an elongate horizontal frame supporting a drum or reel for storing a slick line extending into a well.

Attention is first directed to FIG. 1 of the drawings where the numeral 10 identifies the wellhead equipment which pumps produced oil and water from the well (to be described). Beginning at the left side of FIG. 1, an elongate skid or frame 12 made of two or more parallel frame members extends to the left to thereby support a large storage reel or drum 14. The drum 14 is supported on a centered shaft 16 which is rested on a pillow block 18 and is turned by a motor 15 through a gearbox 26. The shafts 16 are on both sides of the drum so that the drum is able to support a slick line or cable 20 having a length and diameter given below. The cable 20 is the lifting member. The drum is rotated clockwise and counter-clockwise by the electric motor 15 connected through the gearbox 26 to the drum to rotate the drum and thereby make repeated trips in the well to lift the produced oil and some water to the surface.

The frame 12 is supported on a left pylon 22 and a comparable or similar right pylon 24. This keeps it above ground level so that rust is reduced and service can be done. The drum 14 is rotated by the motor 15 through a gearbox 26 driving a chain 28. The motor additionally drives a second and synchronized belt or link chain 30 which connects with a level wind mechanism 32. The level wind mechanism 32 is mounted on a supporting frame member 34. It extends upwardly to position a guide pulley 36 engaging the cable 20 so that the cable 20 is appropriately guided for the reel or drum 14. The level winding mechanism traverses from left to right across or in front of the drum 14. The drum 14 stores the cable 20 on it in bights which are looped around the drum with a level accumulation. The cable is stored on the drum layer by layer across the width of the drum. While each row is wound on the drum, the bights are placed side by side to smoothly accumulate the cable. Among other things, this extends cable life and reduces pinching of the cable where it might be caught between bights and cut by later wraps of the cable on the drum. The level wind mechanism positions the guide pulley 36 so that the cable is moved left and right at a controlled rate which is synchronized with operation of the drum in either direction.

The length of cable extending horizontally is approximately eight feet, so that the guide pulley 36 reciprocates to and fro without undue loading laterally where the cable 20 passes through the pulley 36.

The cable extends to the right side of FIG. 1 and passes over a measuring wheel 40. The measuring wheel has a surrounding groove on it which enables the cable 20 to turn downwardly into the well as will be described. The measuring wheel has three spokes which are counted as each pass by, each count equaling one foot. The spokes pass adjacent to a proximity detector 44. The detector 44 is mounted on a pivoted support arm 46. The arm 46 pivots at a pivot point 48. As observed, the arm 46 can rise and fall about the pivot 48. However, it is supported at a specified location by an anchor cable 50. The anchor cable is tied to a dead end 52. The dead end is supported by fixed frame members 54. It places a load on the dead end which load is measured by a strain gauge 56. The strain gauge measures the tension in the cable 50. With no weight on the cable 20, the strain gauge 56 will provide a baseline reading. When the weight increases, the strain gauge will provide that data. The weight of oil lifted on the cable 20 is directly measured by the strain gauge 56. By having a calibration value, the weight of lifted liquid is then indicated. The cable 50 transfers the load on the measuring wheel 40 to the load sensor 56.

Figure 2:
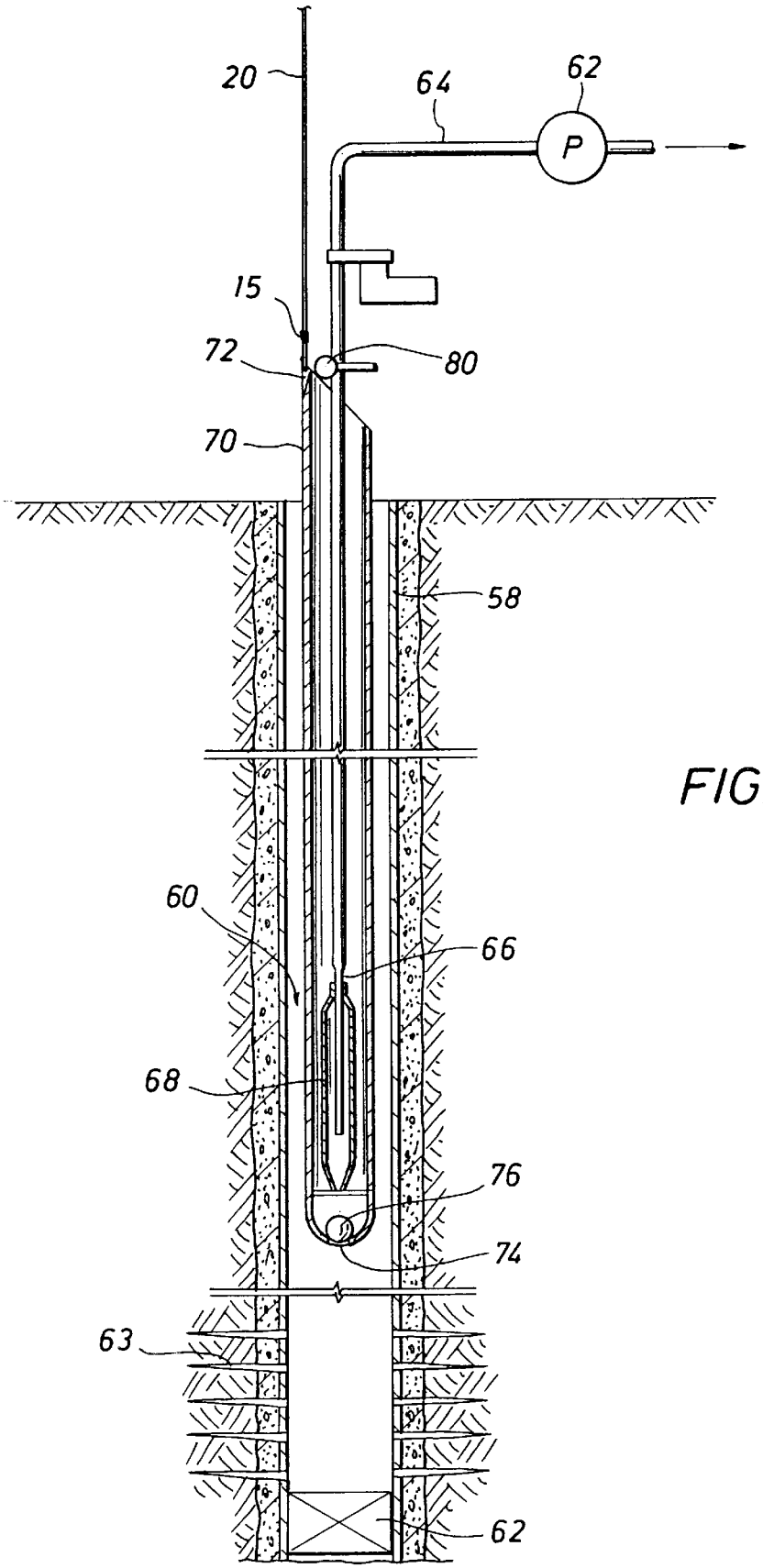
FIG. 2 is a sectional view through the wellhead showing the equipment located at the wellhead including a line supported bail which is raised and lowered on the line operated by the apparatus shown in FIG. 1 for retrieving produced fluid from the well.

Shifting now to FIG. 2 of the drawings, a casing 58 is placed in a well 60 and extends downwardly to the bottom of the well which is plugged with a bridge plug 62. In a manner determined from well to well, a set of perforations 63 enables the adjacent formation to produce oil and some water into the accumulation at the bottom. The wellhead equipment has been omitted in FIG. 2 for sake of clarity. FIG. 2 shows the cable 20 extending vertically so that it can lift the bail 70 which is attached to the cable by swivel eyelet 72 in the well borehole. This removes the accumulated oil bail by bail. The wellhead equipment normally found in the well has not been illustrated but the present invention contemplates the installation of an oil recovery system at this location. The surface equipment includes a pump 62 with an oil line 64 which extends horizontally to the well. The line 64 supports a stinger 66 which terminates at a stinger tip 68. The stinger tip encloses the open end of the stinger. The tip assembly is perforated with multiple openings to enable liquid to enter the stinger. It is preferably enlarged so that a fair number of openings are drilled in it to induct a substantial volumetric flow.

FIG. 2 additionally shows a bail 70 which has the form of an elongate hollow tube. It is open at the top end, having the swivel eyelet 72 for connection with the cable 20. It is closed at the bottom end except a central opening 74 which is plugged by a check valve ball 76. FIG. 2 has been broken away to show the ball which is located in the opening 74 to permit flow into the bail but to prevent leakage from the bail 70. This is the mechanism by which the bail accumulates liquid. The bail has an internal capacity or volume. As a representative dimension, the bail is preferably about 1 to 1½ inches smaller in diameter than the well casing. This enables easy travel of the bail up and down the casing string. It is not uncommon to make the bail between 20 and 30 feet in length. Because it is sized with some clearance with respect to the casing 58, it is more or less centralized in the well so that the stinger is aligned with the centerline axis of the casing. When the bail 70 is retrieved, the open upper end is appropriately aligned so that the stinger tip 68 enters the bail 70. By enlarging the stinger tip 68, it has such a size that it forces entry into the bail even should there be some misalignment.

The check valve 76 limits liquid loss during retrieval of the bail 70. When it is raised, retrieved oil cannot escape through the valve. The produced oil is therefore recovered in the well and delivered to the surface through the stinger by operation of the pump 62.

Travel of the bail 70 should now be considered. The upward range of travel is limited by a proximity switch 80. That switch connects with the electrical supply to switch off power to the motor 15. This holds the bail in the raised position shown in FIG. 2 against the switch 80. This is the upper limit of travel. The proximity detector 44 counts spokes (meaning feet of cable) to initiate operation of the pump 62, the proper time when the bail is near the stinger tip 68. Accordingly, when the motor 15 is switched off to end travel, the pump 62 is switched on to extract oil in the bail 70. The recovered oil is delivered through the pump 62 to a gathering system. This retrieves the oil from the bail to the depth of the stinger tip 68. Substantially all the bail carried oil is collected. The pump 62 will stop when the weight set point is achieved. In other words, when the strain gauge 56 indicates that all of the fluid has been removed, the pump 62 is switched off and the motor 15 is then switched on to lower the bail 70 back into the well.

The switch 80 initiates a signal stopping motor operation, holding the bail at the raised location while arresting travel of the cable and bail. Since operation of the pump 62 is switched off when the oil is pumped out, that indicates liquid has been fully retrieved. After oil removal, the motor 15 is operated in the reverse direction to thereby lower the bail into the well. The measuring wheel 40 is rotated for a specified number of intervals until the bail is close to the liquid level in the well. In ordinary operation of the well, the recovered liquid will accumulate to a specified head. The head of liquid defines a depth at which recovery can begin from the well. This head of liquid will have a certain depth in the well. Assume as an easy example that the head of liquid is exactly 1,000 feet below the equipment shown in FIG. 1. The measuring wheel 40 rotates to measure the length of cable spooled into the well so that the cable can be slowed as the accumulated head is approached. The motor 15 can therefore run at a relatively high speed until the bail is within about 50 feet or so. At that point, rotations of the measuring wheel trigger a change in motor speed. The motor is preferably slowed. At this juncture the weight on the cable 20 is measured. The weight is measured at the dead end sensor 56 and the weight comprises only two components which are the weight of the empty bail and the weight of cable hanging over the measuring wheel. The motor is slowed so that the bail then moves downwardly into the accumulated head of oil; at this point the buoyancy of the empty bail reduces the weight at the dead end sensor 56. The filling rate is defined primarily by the opening 74 at the bottom of the bail. The buoyancy is used to advantage as a load related signal. The motor 15 is operated slowly while the reduced load is sensed on the dead sensor 56. As the bail fills, the load on the cable 20 will change. This load will change, thereby forming a signal that the load is changing with filling. As that load ultimately changes, it will form an indication that the bail has been fully filled to the top. After that occurs, the weight on the measuring wheel will be substantially restored because filling of the bail reduces the buoyant effect of floating on the surface. Moreover that event triggers operation of the motor to then raise the cable and bail by operating in the opposite direction. The motor is then operated to retrieve the cable 20 and thereby lift the bail.

The cable preferably has a length equal to the depth of the well plus added length to enable the cable to be periodically inspected and the ends trimmed. In addition the cable has a diameter sufficient to raise the weight involved. That total weight on the cable is the empty weight of the bail, the weight of enclosed liquid (approximately 8 pounds per gallon), and the weight of the cable itself. Cable diameter is preferably sufficient to carry the above mentioned load plus as safety margin of perhaps an additional 1,000 pounds or so. A single strand slick line or woven cable are both equally acceptable provided they have the capacity and length noted.

The operating cycle should be noted. Any well has a maximum production rate. As it is pumped off, production will typically increase somewhat but not excessively. The production rate should therefore be adjusted so that the percolation rate of oil and water from the formation is steadily matched with the rate at which the lifted liquid consistently removed. Each cycle of operation involves four events in sequence which are (1) the time to lower the bail from the surface to the head of oil, (2) the time for the bail to fill, (3) the retrieval interval, and (4) the interval of time during which the pump 62 removes the oil. Filling and draining typically occur in a span of just two or three minutes. Travel along a well of 1,000 feet should be at a rate of between 50 and 100 feet per minute. Retrieval under load is typically about the same speed or slower. Accordingly, in a 1,000 foot well and using rates of 50 feet per minute, this involves a cycle of operation of about 20 minutes to lower the bail, three or four minutes to fill the bail, 20 minutes for retrieval and about 4 minutes for draining. The total cycle will be somewhere between 45 and 50 minutes. At that rate, the system can make about 25 to 30 trips per day. If the well is producing 10 barrels of oil and water daily, and 30 trips are made, then one-third barrel each trip should be retrieved. This defines an approximate scale for the bail in this context. If another well produces 24 barrels per day, then one barrel must be removed each hour. With a bail of one-half barrel, the rate of travel must be two trips per hour to produce that well.

In the preferred embodiment, the cable 20 has a diameter of 0.072 inches and the bail has a capacity of 11 gallons, thereby representing a total bail weight (when filled) of 175 pounds. The bail 70 can be conveniently made from a pipe joint by trimming the upper end as illustrated and equipping the lower end with the valve mechanism previously mentioned.

At the time of service, the preliminary steps for executing service are simply removal of the bail 70 and the stinger 64. They are set aside to clear the well borehole to permit easy access to it. While the bail may be fairly long, even 25 or 30 feet in length, the size of the bail enables easy handling by one service person. Accordingly, service of the present system is done more easily than heretofore. In fact, a workover rig is not needed or this kind of service. Rather, spaghetti tubing on a drum can be used in washing the well.

While the foregoing is directed to the preferred embodiment, the scope is determined by the claims which follow.

I claim:

1. A well pumping apparatus comprising:

(a) a support adjacent to a wellhead;

(b) a drum storing cable operable in both directions to retrieve or extend therefrom wherein the cable extends into the well borehole;

(d) a bail attached to the end of the cable;

(e) a stinger adapted to insert into the bail on retrieval thereof to enable stinger removal of bail carried oil from the borehole; and (f) a control system for responsively lowering and raising the bail to thereby remove produced liquids from the well in the bail and to return the bail in the well borehole for cyclic operation.

2. The apparatus of claim 1 wherein said drum is motor driven to operate said cable and said motor is operated by said control system.

3. The apparatus of claim 2 wherein said motor connects to said drum for rotation thereof, and said motor and drum control wireline tension to enable wireline winding on said drum.

4. The apparatus of claim 1 wherein said control system comprises a cable position sensor responsive to cable position to move said cable.

5. The apparatus of claim 1 wherein said control system comprises a cable weight sensor responsive to cable position to move said cable.

6. The apparatus of claim 1 wherein said bail includes a bottom located filing valve.

7. The apparatus of claim 6 wherein said stinger removal of bail carried means is by pneumatic means.

8. The apparatus of claim 6 wherein said control system comprises a cable weight sensor which cooperates with said filling valve to control the filling of said bail with said produced liquids.

9. A method of producing a stripper well comprising the steps of:

(a) lowering a bail into a well on a wireline;

(b) filling the bail with produced well liquids;

(c) retrieving the bail to a position near a wellhead of the well;

(d) inserting a stinger into the retrieved bail during retrieval so that the stinger extends into the recovered well liquids in the bail;

(e) pumping through the stinger to retrieve liquid; and (f) lowering the bail into the well for subsequent retrieval of additional well liquids.

10. The method of claim 9 wherein the bail is raised and lowered controllably by measuring the weight on the cable.

11. The method of claim 10 including the preliminary step of positioning the stinger in the well to align with and enter the top open end of said bail for liquid retrieval.

12. The method of claim 11 including the step of filling the bail through a selectively opened valve.

13. The method of claim 11 including the step of opening and closing a check valve to control bail filling.

14. The method of claim 9 including the step of weighing the bail to control bail lowering.

15. The method of claim 14 including the step of weighing the bail to control bail retrieving.

16. The method of claim 9 including the step of moving the bail toward the surface until a switch is operated by bail movement.

17. The method of claim 1 wherein steps 1(a) through 1(d) are sequentially and indefinitely repeated to recover oil.

18. The method of claim 9 including the step of passing the wireline over a measuring wheel to measure bail location.

19. The method of claim 18 including the step of moving the bail at different speeds.

20. The method of claim 1 wherein said well liquids are pneumatically removed from said bail by said pumping through said stinger.

* * * * *